US007475833B2

(12) United States Patent
Chih

(10) Patent No.: US 7,475,833 B2
(45) Date of Patent: Jan. 13, 2009

(54) SPRINKLING HEAD STRUCTURE OF A SPRINKLER

(76) Inventor: Gordon Chih, No. 33, Tien-Yang Lane, Chao-An Li, Liu-Kang Chen, Changhua Hsien (TW)

( * ) Notice: Subject to any disclaimer, the term of this patent is extended or adjusted under 35 U.S.C. 154(b) by 0 days.

(21) Appl. No.: 11/402,043

(22) Filed: Apr. 12, 2006

(65) Prior Publication Data

US 2006/0237560 A1 Oct. 26, 2006

(30) Foreign Application Priority Data

Apr. 25, 2005 (TW) ..... 94206453 U

(51) Int. Cl.
*A62C 31/02* (2006.01)

(52) U.S. Cl. ..... 239/394; 239/383; 239/437; 239/440; 239/444; 239/446; 239/556; 239/558

(58) Field of Classification Search ..... 239/456, 239/457, 460, 394, 383, 446, 440, 548, 558, 239/556, 447, 437, 451, 393
See application file for complete search history.

(56) References Cited

U.S. PATENT DOCUMENTS 5,823,442 A * 10/1998 Guo ..... 239/394
6,164,566 A * 12/2000 Hui-Chen ..... 239/394
6,866,208 B2 * 3/2005 Kao ..... 239/526
6,905,082 B1 * 6/2005 Wu ..... 239/436

* cited by examiner

*Primary Examiner*—Dinh Q Nguyen
(74) *Attorney, Agent, or Firm*—Troxell Law Office, PLLC

(57) ABSTRACT

A sprinkling head structure of a sprinkler includes a sprinkling head and a guide section. The sprinkling head is a substantially hollow cylindrical body. A first face of the sprinkling head is formed with multiple first outgoing openings which are annularly arranged. A second face of the sprinkling head is formed with multiple second incoming openings respectively corresponding to the first outgoing openings. The guide section is disposed inside the sprinkling head, including multiple passages and at least one channel. The passages communicate with two faces of the guide section. First ends and second ends of the passages respectively correspond to the first openings and second openings. The channel directly communicates with at least two of the passages. The water flow can be at the same time discharged from at least two of the first openings.

2 Claims, 6 Drawing Sheets

SPRINKLING HEAD STRUCTURE OF A SPRINKLER

BACKGROUND OF THE INVENTION

The present invention is related to a sprinkling head structure of a sprinkler, and more particularly to a sprinkling head structure capable of discharging water flow from at least two openings at the same time.

The sprinkling head structure of a conventional sprinkling gun has a sprinkling head and a connecting body. The sprinkling head is rotatably connected with the sprinkling gun corresponding to a water outlet. The sprinkling head is formed with various figures of annularly arranged sprinkling openings any of which can be aligned with the water outlet. Each opening has an inward extending wall with a certain height. The connecting body is disposed between the sprinkling head and the water outlet. The connecting body is formed with multiple water outlet sockets respectively corresponding to the openings and the water outlet. At one time, a user can only select one of the openings to discharge water from the opening. Therefore, the sprinkling area and effect are limited. In the case that the water can be discharged from at least two openings, the sprinkling effect will be better. For example, when watering flowers or cleaning articles, it costs less time to sprinkle water onto the flowers and an evener sprinkling effect can be achieved. This is like that a shaver with more than two blades can achieve better shaving effect.

U.S. Pat. No. 6,113,009 discloses a sprinkling head structure capable of discharging water from two openings at one time. An inner space is surrounded and defined by annularly arranged water outlet sockets. A cylindrical connecting block is additionally mounted in the inner space. The connecting block is formed with a water passage. The lateral walls of the two water outlet sockets corresponding to two ends of the water passage are formed with openings. Accordingly, the water can be discharged from two sprinkling openings at one time. However, such structure has some shortcomings as follows:

1. The connecting block must have a considerable height for smoothening the water flow. As a result, the connecting block has a larger volume. This increases the cost for the material and the design of the profile of the sprinkling head is limited.
2. The connecting block is positioned in the inner space to serve as a water passage. The conventional screw for connecting the sprinkling gun with the sprinkling head must be removed. Accordingly, the sprinkling gun and the sprinkling head are hooked and latched with each other without using any screw. In the case that the sprinkling head is clogged by dirt and needs to be cleaned, a user himself/herself will be unable to disassemble the sprinkling head. Under such circumstance, the sprinkling gun will become useless.
3. The two ends of the water passage of the connecting block and the openings of the lateral walls of the water outlet sockets must be watertight connected. A differential leakproof gasket must be added between the two ends of the water passage and the openings of the lateral walls of the water outlet sockets. It is difficult to assemble these components and the watertight effect is poor. As a result, the ratio of defective products is relatively high.

SUMMARY OF THE INVENTION

It is therefore a primary object of the present invention to provide a sprinkling head structure capable of discharging water flow from at least two openings at the same time. In addition, it is easy to assemble the components of the sprinkling head structure.

It is a further object of the present invention to provide the above sprinkling head structure capable of discharging water flow from at least two openings at the same time. In addition, the number of components of the sprinkling head structure is reduced.

According to the above objects, the sprinkling head structure of the present invention includes a sprinkling head and a guide section. The sprinkling head is a substantially hollow cylindrical body. A first face of the sprinkling head is formed with multiple first outgoing openings which are annularly arranged. A second face of the sprinkling head is formed with multiple second incoming openings respectively corresponding to the first outgoing openings. The guide section is disposed inside the sprinkling head, including multiple passages and at least one channel. The passages communicate with two faces of the guide section. First ends and second ends of the passages respectively correspond to the first openings and second openings. The channel directly communicates with at least two of the passages.

The present invention can be best understood through the following description and accompanying drawings wherein:

DETAILED DESCRIPTION OF THE PREFERRED EMBODIMENTS

Figure 1:
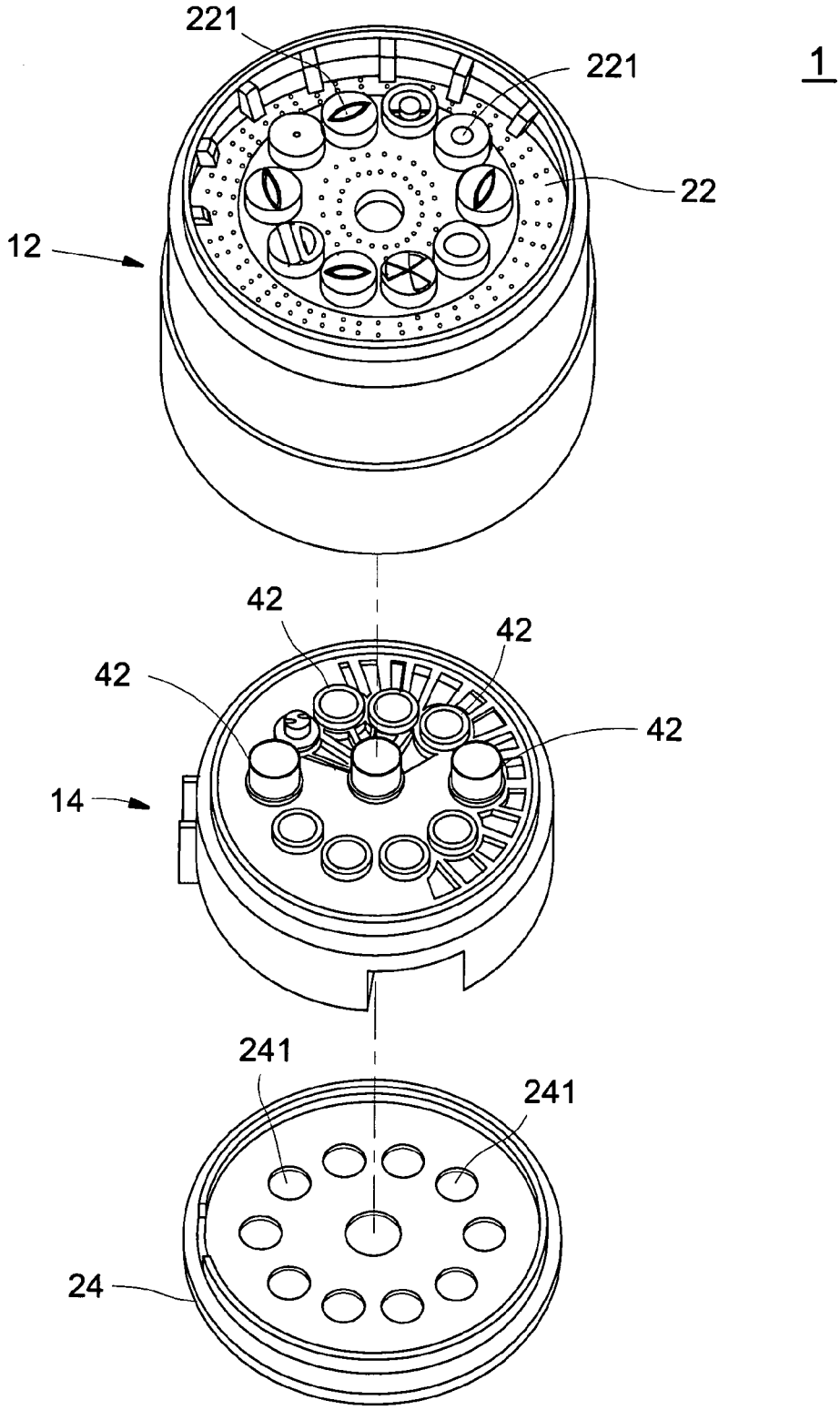
FIG. 1 is a perspective exploded view of a preferred embodiment of the present invention.

Please refer to FIGS. 1 to 10. The sprinkling head structure 1 of the sprinkler of the present invention includes a sprinkling head 12 and a guide section 14.

The sprinkling head 12 is a substantially hollow cylindrical body. A first face 22 of the sprinkling head 12 is formed with multiple first outgoing openings 221 which are annularly arranged. A second face 24 of the sprinkling head 12 is formed with multiple second incoming openings 241 respectively corresponding to the first outgoing openings 221. The sprinkling head 12 is rotatably connected with a main body ( not shown ) corresponding to a water outlet 10 thereof. The second openings 241 can be located respectively in alignment with the water outlet 10. The second face 24 can be a separate plate fixedly connected with the sprinkling head.

The guide section 14 is disposed inside the sprinkling head 12, including multiple passages 42 and at least one channel 44.

The passages 42 communicate with two faces of the guide section 14. First ends and second ends of the passages 42 respectively correspond to the first openings 221 and second openings 241, whereby the water coming from the water outlet 10 can flow through the passages 42 toward the first openings 221 of the sprinkling head 12. One face of the guide section 14 has an inner space 421 surrounded and defined by the passages 42 and an outer space 422 not surrounded by the passages 42.

The channel 44 directly communicates with at least two of the passages 42. The channel 44 is positioned in the inner space 421. In general, the cross-sectional area of the outlet of the first opening 221 is smaller than the cross-sectional area of the inlet of the first opening 221. This design is for creating different figures of sprinkled water. When the water outlet 10 is aligned with the two passages 42 communicating with the channel 44, a water flow can be distributed and guided to two of the first openings 221 to discharge water from the two first openings.

According to the above arrangement, the sprinkling head structure 1 of the present invention has the following advantages:

1. The channel 44 of the inner space 421 directly communicates with two of the passages 42. Therefore, the connecting block of U.S. Pat. No. 6,113,009 is omissible. Therefore, the volume of the sprinkling head 12 can be minified and the profile of the sprinkling head 12 can be more freely designed.
2. The differential leakproof gasket can be omitted.
3. The components can be easily assembled to achieve better watertight effect and enhance the ratio of good products.
4. The cost for the material is reduced.

Figure 2:
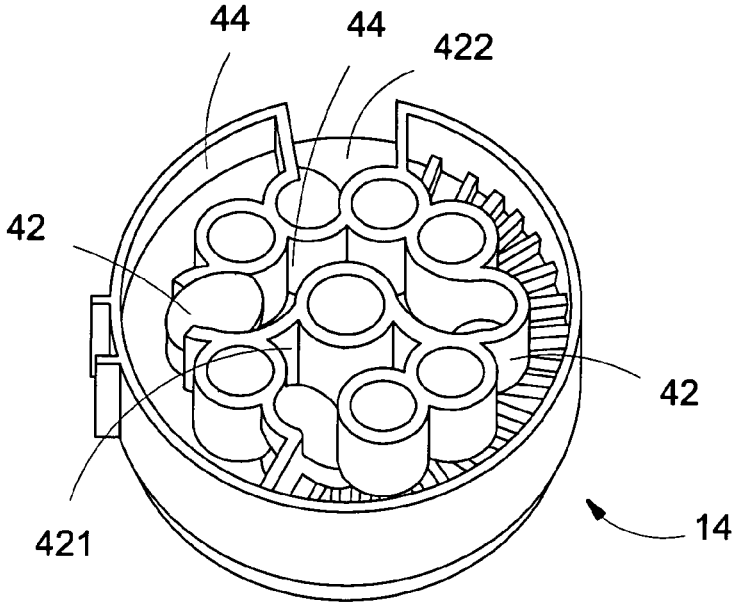
FIG. 2 is a perspective bottom view of the guide section of the present invention according to FIG. 1, in which the guide section is reversed.
Figure 3:
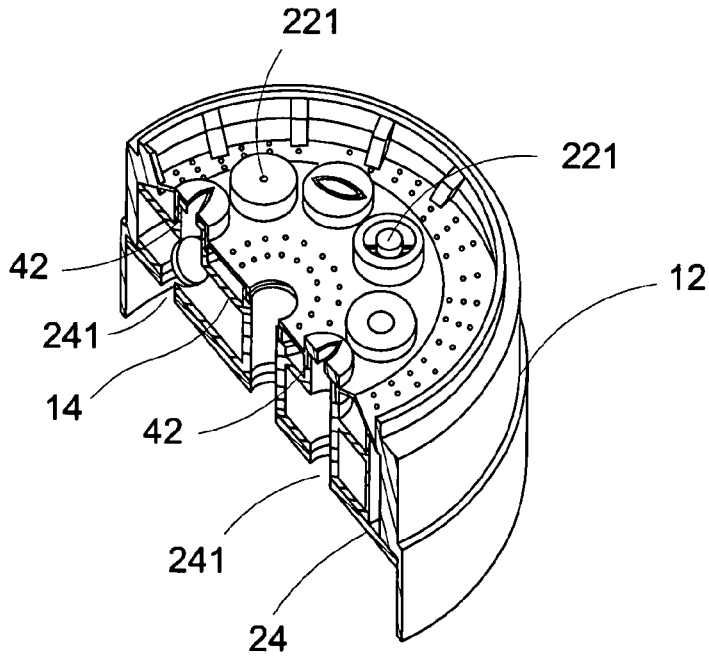
FIG. 3 is a perspective sectional view of the preferred embodiment of the present invention.
Figure 4:
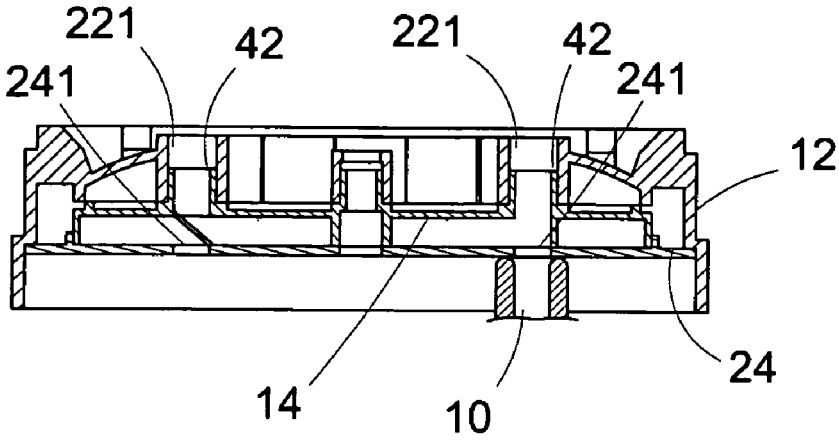
FIG. 4 is a side sectional assembled view according to FIG. 3.
Figure 5:
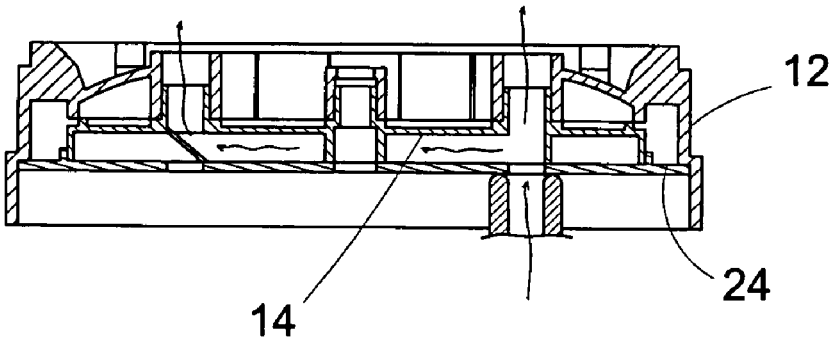
FIG. 5 is a sectional view according to FIG. 4, showing the water flow of a channel in the inner space of the guide section.
Figure 6:
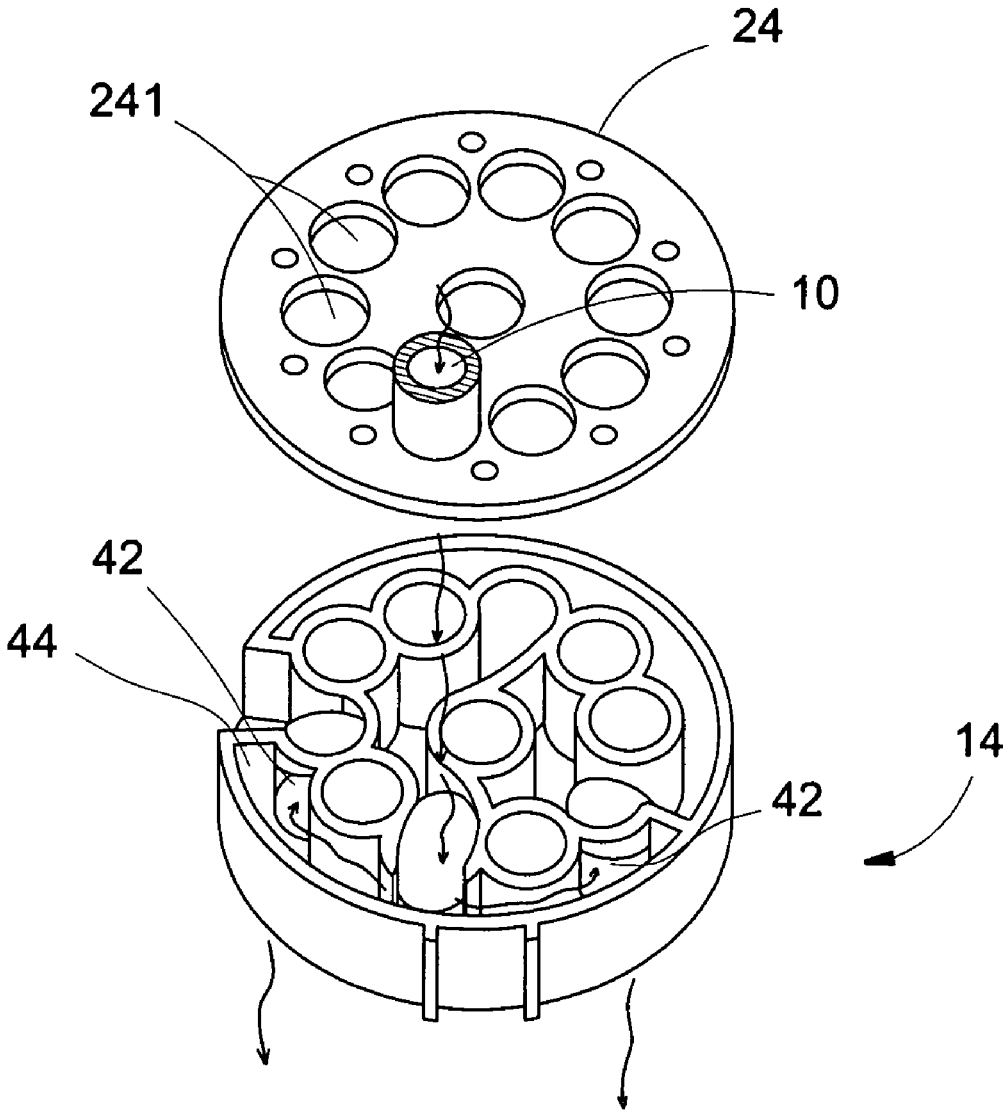
FIG. 6 is a perspective view showing the water flow of a channel in the outer space of the guide section.
Figure 7:
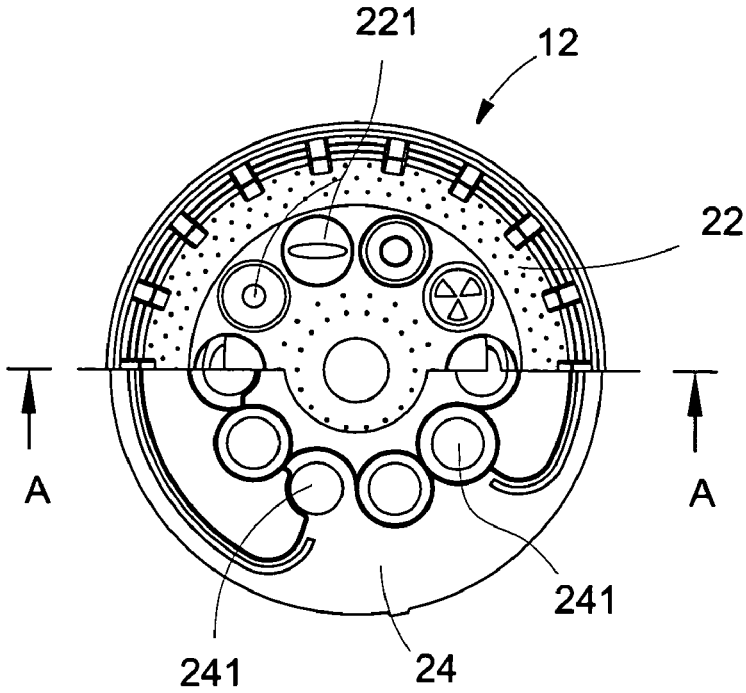
FIG. 7 is a partially sectional top view of the preferred embodiment of the present invention.
Figure 8:
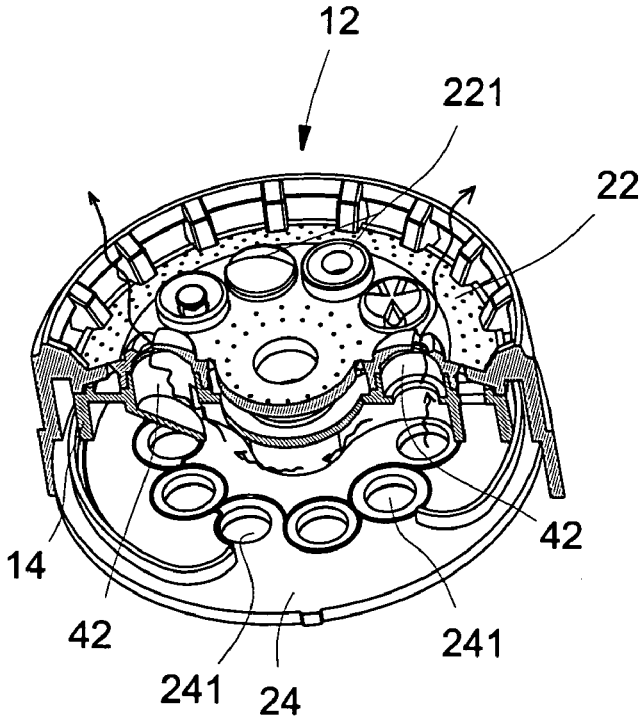
FIG. 8 is a sectional view taken along line A-A of FIG. 7, showing the water flow in the inner space.
Figure 9:
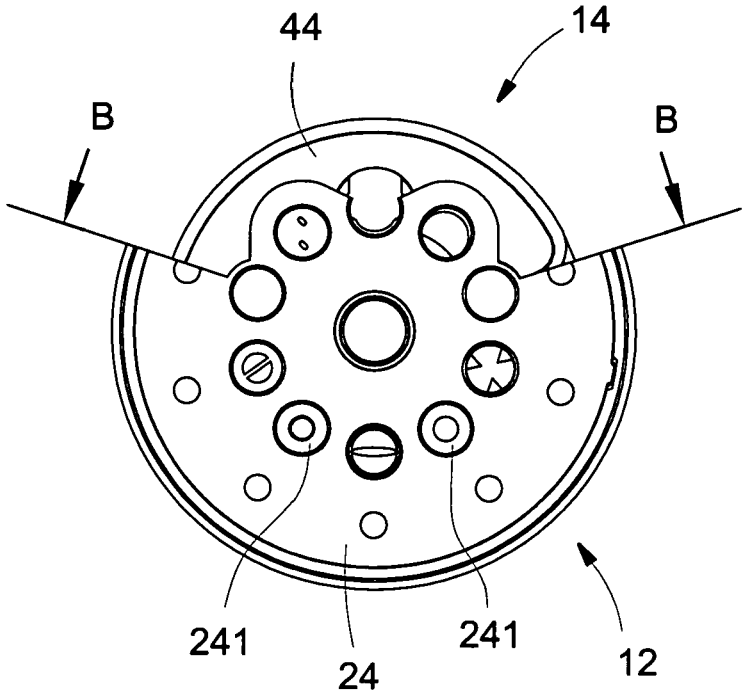
FIG. 9 is a partially sectional top view according to FIG. 7 in another direction.
Figure 10:
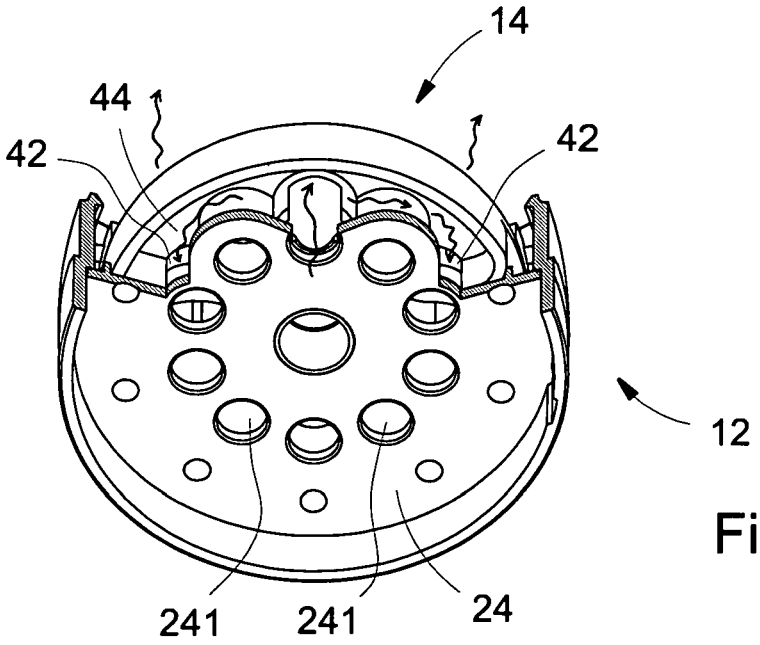
FIG. 10 is a sectional view taken along line B-B of FIG. 9, showing the water flow in the outer space.

FIG. 2 also simultaneously shows a second embodiment of the present invention, in which the channel 44 is disposed in the outer space 422 to achieve the same effect.

The inner and outer spaces 421, 422 are formed on one face of the guide section 14 corresponding to the second openings 241 for more smoothly guiding the water flow.

With respect to the structure in which the channel 44 is positioned in the inner space 421, the two passages 42 corresponding to two ends of the channel 44 respectively communicate with the channel via extending walls of the opening of lateral wall and the opening of one end.

With respect to the structure in which the channel 44 is positioned in the outer space 422, the two passages 42 corresponding to two ends of the channel 44 respectively communicate with the channel 44 via extending walls of the opening of one end.

The above embodiments are only used to illustrate the present invention, not intended to limit the scope thereof. Many modifications of the above embodiments can be made without departing from the spirit of the present invention.

What is claimed is:

1. A sprinkling head structure of a sprinkler, comprising:

a sprinkling head which is a substantially hollow cylindrical body, a first face of the sprinkling head being formed with multiple first outgoing openings which are annularly arranged, a second face of the sprinkling head being formed with multiple second incoming openings respectively corresponding to the first outgoing openings; and a guide section disposed inside the sprinkling head, including multiple passages and at least one channel, the passages communicating with two faces of the guide section, first ends and second ends of the passages respectively corresponding to the first openings and second openings, the channel directly communicating with at least two of the passages, wherein one face of the guide section has an inner space surrounded and defined by the passages and an outer space not surrounded by the passages, the channel being positioned in the inner space or in the outer space, wherein the two passages corresponding to two ends of the channel respectively communicate with the channel via extending walls of the opening of one end.

2. The sprinkling head structure of the sprinkler as claimed, in claim 1, wherein the inner and outer spaces correspond to the second openings.

* * * * *